US006313859B1

(12) United States Patent
Kerr et al.

(10) Patent No.: US 6,313,859 B1
(45) Date of Patent: Nov. 6, 2001

(54) METHOD AND APPARATUS FOR AXIAL DIRECTION SHEET FEED TO A VACUUM DRUM

(75) Inventors: Roger S. Kerr, Brockport; Kurt M. Sanger, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/571,350

(22) Filed: May 16, 2000

(51) Int. Cl.[7] ..... B41J 17/28
(52) U.S. Cl. ..... 347/217; 242/528
(58) Field of Search ..... 242/528; 347/217, 347/218, 224, 262, 264; 101/219, 216; 226/168

(56) References Cited

U.S. PATENT DOCUMENTS

| | | | | |
|---|---|---|---|---|
| 4,779,783 | * | 10/1988 | Fischer et al. | 226/168 |
| 4,932,322 | * | 6/1990 | Keller | 101/219 |
| 4,967,659 | * | 11/1990 | Goodwin et al. | 101/216 |
| 5,268,708 | | 12/1993 | Harshbarger et al. | 346/134 |
| 5,276,464 | | 1/1994 | Kerr et al. | 346/134 |
| 5,777,658 | | 7/1998 | Kerr et al. | 347/215 |
| 5,852,464 | * | 12/1998 | Hebert et al. | 347/215 |
| 6,002,419 | | 12/1999 | Kerr et al. | 347/233 |
| 6,014,162 | | 1/2000 | Kerr et al. | 347/262 |
| 6,037,960 | | 3/2000 | Kerr et al. | 347/172 |

OTHER PUBLICATIONS

Kerr, "A Print Engine Chassis Having Adjustable Sidewall Thickness", USSN 09/499,813, (80296/NAB), filed Feb. 8, 2000.

* cited by examiner

*Primary Examiner*—N. Le
*Assistant Examiner*—K. Feggins
(74) *Attorney, Agent, or Firm*—Harleston Law Firm

(57) ABSTRACT

An image processing apparatus (10) for sheet thermal print media includes an imaging drum (300) for holding thermal print media (32) and donor material (36) in registration on the vacuum imaging drum. In order to decrease the incidence of visible defects in images produced by the apparatus, the imaging drum (300) has its axis in parallel with the feed direction of the media. A method for improving the quality of images produced by an image processing apparatus (10) having a horizontally disposed imaging drum (300), which includes loading pre-cut, thermal print media into the image processing apparatus in a direction which is parallel to the axis of the imaging drum is also included.

8 Claims, 9 Drawing Sheets

METHOD AND APPARATUS FOR AXIAL DIRECTION SHEET FEED TO A VACUUM DRUM

FIELD OF THE INVENTION

This invention relates to media handling in an image processing apparatus and, more particularly, to an improved apparatus and method for feeding sheet media to a vacuum drum.

BACKGROUND OF THE INVENTION

Pre-press color proofing is a procedure that is used by the printing industry for creating representative images of printed material without the high cost and time that is required to actually produce printing plates and set up a high-speed, high-volume, printing press in order to produce a single example of an intended image. These intended images may require several corrections and may need to be reproduced several times to satisfy customer requirements. This can result in a large loss of profits. By utilizing pre-press color proofing time and money can be saved.

One such commercially available image processing apparatus, which is depicted in commonly assigned U.S. Pat. No. 5,268,708 to Harshbarger et al., is an image processing apparatus having half-tone color proofing capabilities. This image processing apparatus is arranged to form an intended image on a sheet of thermal print media by transferring dye from a sheet of dye donor material to the thermal print media. This is accomplished by applying a sufficient amount of thermal energy to the dye donor material to form an intended image. This image processing apparatus is comprised generally of a material supply assembly or carousel, lathe bed scanning subsystem (which includes a lathe bed scanning frame, translation drive, translation stage member, print-head, and vacuum imaging drum), and thermal print media and dye donor material exit transports.

The operation of the image processing apparatus comprises metering a length of the thermal print media (in roll form) from the material assembly or carousel. The thermal print media is then measured and cut into sheet form of the required length and transported to the vacuum imaging drum, registered, wrapped around and secured onto the vacuum imaging drum. Next a length of dye donor material (in roll form) is also metered out of the material supply assembly or carousel, then measured and cut into sheet form of the required length. It is then transported to and wrapped around the vacuum imaging drum, such that it is superposed in the desired registration with respect to the thermal print media (which has already been secured to the vacuum imaging drum).

After the dye donor material is secured to the periphery of the vacuum imaging drum, the scanning subsystem or write engine provides the scanning function. This is accomplished by retaining the thermal print media and the dye donor material on the spinning vacuum imaging drum while it is rotated past the printhead that will expose the thermal print media. The translation drive then traverses the printhead and translation stage member axially along the vacuum imaging drum, in coordinated motion with the rotating vacuum imaging drum. These movements combine to produce the intended image on the thermal print media.

After the intended image has been written on the thermal print media, the dye donor material is then removed from the vacuum imaging drum. This is done without disturbing the thermal print media that is beneath it. The dye donor material is then transported out of the image processing apparatus by the dye donor material exit transport. Additional dye donor materials are sequentially superposed with the thermal print media on the vacuum imaging drum, then imaged onto the thermal print media as previously mentioned, until the intended image is completed. The completed image on the thermal print media is then unloaded from the vacuum imaging drum and transported to an external holding tray on the image processing apparatus by the receiver sheet material exit transport.

The scanning subsystem, or write engine, of the lathe bed scanning type comprises the mechanism that provides the mechanical actuators for imaging drum positioning and motion control to facilitate placement, loading onto, and removal of the thermal print media and the dye donor material from the vacuum imaging drum. The scanning subsystem, or write engine, provides the scanning function by retaining the thermal print media and dye donor material on the rotating vacuum imaging drum. This generates a once per revolution timing signal to the data path electronics as a clock signal while the translation drive traverses the translation stage member and printhead axially along the vacuum imaging drum in a coordinated motion with the vacuum imaging drum rotating past the printhead. This is done with positional accuracy maintained, to allow precise control of the placement of each pixel, in order to produce the intended image on the thermal print media.

The lathe bed scanning frame provides the structure to support the vacuum imaging drum and its rotational drive. The translation drive with the translation stage member and printhead are supported by the two translation bearing rods, which are substantially straight along their longitudinal axis and positioned parallel to the vacuum imaging drum and lead screw. Consequently, they are parallel to each other, forming a plane along with the vacuum imaging drum and lead screw.

The translation bearing rods are, in turn, supported by the outside walls of the lathe bed scanning frame of the lathe bed scanning subsystem or write engine. The translation bearing rods are positioned and aligned therebetween, for permitting low friction movement of the translation stage member and the translation drive. The translation bearing rods are sufficiently rigid for this application, so as not to sag or distort between the mounting points at their ends. They are preferably as exactly parallel as is possible with the axis of the vacuum imaging drum. The front translation bearing rod is preferably arranged so that the axis of the printhead lies precisely on the axis of the vacuum imaging drum. The axis of the printhead is located perpendicular, vertical, and horizontal to the axis of the vacuum imaging drum. The translation stage member front bearing is arranged to form an inverted "V". The translation stage member, with the printhead mounted on the translation stage member, is preferably held in place only by its own weight. The rear translation bearing rod locates the translation stage member—with respect to rotation of the translation stage member—about the axis of the front translation bearing rod. This is done so that there is no over constraint of the translation stage member that might cause it to bind, chatter, or otherwise impart undesirable vibration to the translation drive or printhead during the writing process. Such vibrations can cause unacceptable artifacts in the intended image. This benefit is accomplished by the rear bearing, which engages the rear translation bearing rod on the diametrically opposite side of the translation bearing rod on a line that is perpendicular to a line connecting the centerlines of the front and rear translation bearing rods.

The translation drive is for permitting relative movement of the printhead by synchronizing the motion of the printhead and stage assembly such that the required movement is made smoothly and evenly throughout each rotation of the drum. A clock signal generated by a drum encoder provides the necessary reference signal accurately indicating the position of the drum. This coordinated motion results in the printhead tracing out a helical pattern around the periphery of the drum. The coordinated motion is accomplished by means of a DC servo motor and encoder which rotates a lead screw that is typically, aligned parallel with the axis of the vacuum imaging drum. The printhead is preferably placed on the translation stage member in a "V" shaped groove, which is formed in the translation stage member. The printhead is selectively locatable with respect to the translation stage member, thus it is positioned with respect to the vacuum imaging drum surface. By adjusting the distance between the printhead and the vacuum imaging drum surface, as well as angular position of the printhead about its axis using adjustment screws, an accurate means of adjustment for the printhead is provided. Extension springs provide the load against these two adjustment means. The translation stage member and printhead are attached to a rotatable lead screw (having a threaded shaft) by a drive nut and coupling. The coupling is arranged to accommodate misalignment of the drive nut and lead screw so that only rotational forces and forces parallel to the lead screw are imparted to the translation stage member by the lead screw and drive nut. The lead screw rests between two sides of the lathe bed scanning frame of the lathe bed scanning subsystem or write engine, where it is supported by deep groove radial bearings. At the drive end the lead screw continues through the deep groove radial bearing, through a pair of spring retainers, that are separated and loaded by a compression spring to provide axial loading, and to a DC servo drive motor and encoder. The DC servo drive motor induces rotation to the lead screw moving the translation stage member and printhead along the threaded shaft as the lead screw is rotated. The lateral directional movement of the printhead is controlled by switching the direction of rotation of the DC servo drive motor and thus the lead screw.

The printhead includes a plurality of laser diodes which are coupled to the printhead by fiber optic cables which can be individually modulated to supply energy to selected areas of the thermal print media in accordance with an information signal. The printhead of the image processing apparatus includes a plurality of optical fibers coupled to the laser diodes at one end and the other end to a fiber optic array within the printhead. The printhead is movable relative to the longitudinal axis of the vacuum imaging drum. The dye is transferred to the thermal print media as the radiation, transferred from the laser diodes by the optical fibers to the printhead and thus to the dye donor material and is converted to thermal energy in the dye donor material.

Although the presently known and utilized image processing apparatus is satisfactory, it is not without drawbacks. As noted above, thermal print media is stored in roll form inside the apparatus and is metered and slit to length as needed. The cut edge requires a precision cut so that the media wraps closely about the vacuum drum. An imperfect cut can cause the media to seal improperly to the vacuum provided by the vacuum drum. Imperfectly cut media may even protrude slightly from the drum periphery. Since drum rotation is at high RPM (600 RPM and higher), this could result in loss of vacuum seal, which can cause fly-off of the media, loss of the print job in process, and even damage to equipment optics. Because the media is in the form of a polyester sheet, such as a film-base, cutting components must be carefully designed to prevent buckling or curling. These effects are known to be a problem in slitting sheets of such material.

Another drawback of the conventional approach to media sheet feed for such devices is caused by the requirement, inherent to the use of a vacuum drum, that the sheet wraps almost completely about the drum circumference. Regardless of the image size, the same size thermal media sheet must be loaded onto the vacuum drum. This adds cost and waste to the printing process. In order to allow imaging on a sheet of a different size, the media manufacturer must produce media having a different width. The imaging apparatus manufacturer must provide a different imaging drum that is dimensioned to handle a different paper size. This arrangement proves inflexible for manufacturers of imaging systems and their customers alike.

Yet another drawback of the conventional approach to media sheet feed is a result of the method used for writing an image onto thermal media that is loaded on a rotating vacuum drum. In media manufacture, as the plastic sheets are processed and coated, any variation in coating tends to be along the width of the roll, rather than the length. This is due, in part, to some stretching of the roll during processing. The polyester film base is pulled and stretched while it is being drawn. The coating process has a consistent variation in the widthwise direction while the roll is being coated. The lengthwise coating variations are related to the film transport, coating materials transport, and coating drying process. These variations are typically random and do not create as strong an error as the widthwise coating variations. For some processes, such as Gravure coating, the cylinder used will contribute a strong, once-per-cycle error signature. However, the variations across the cylinder will usually be more objectionable. This variation contributes to banding and streak artifacts in the printed image. The printhead of the apparatus is translated in the direction of the roll width as the media sheet rotates on the drum (rotating in the direction of the roll length). The image is written in a helical swath pattern, which runs very nearly parallel to the direction of roll length. Any banding that is detectable due to the writing operation tends to occur along and between swaths, in the same direction as banding due to roll coating variation. Thus, using conventional sheet feed, both the inherent roll coating characteristics and the writing pattern have an additive effect on banding and streaks in the image.

For apparatus that use an imaging drum, sheet feed from rolled media onto the imaging drum conventionally follows the roll direction. That is, the imaging drum acts as a "roll" with its axis parallel to the axis of any media supply roll. This is the case with thermal printers, such as those disclosed in U.S. Pat. No. 5,276,464, Kerr et al., issued Jan. 4, 1994. This is also true for numerous other imaging devices that employ an imaging drum or cylinder, such as inkjet printers.

It can be seen that there are inherent problems with conventional image processing apparatus and that there is, therefore, a need for solutions to overcome these problems. The present invention concerns an image processing apparatus in which a vacuum drum holds imaging media. On the vacuum drum, a sheet of receiver media is retained in position, with a sheet of donor media superposed over the receiver media. Donor and receiver media are provided on a carousel that stores individual rolls of receiver media, and color donor media. To load a sheet of media onto the imaging drum, the apparatus rotates the carousel into position for the intended media. The media is metered from the roll, cut to length, and fed into a receiving area for pickup by the vacuum drum. The media feed direction is parallel to the axis of the vacuum drum and the media roll width is provided in proper dimension for wrapping media about the drum circumference, thus allowing a variable length of media to be supplied to the drum.

In the apparatus of the present invention, media sheets are loaded onto the vacuum drum, where the sheet feed direction is parallel to the drum axis. Precision cutting of the media within the image processing apparatus is generally not needed, since cut edges of the media lie along the direction of high-speed drum rotation and are thus not likely to cause problems of fly-off if cut imperfectly. The present apparatus allows a user to load a media sheet of appropriate length for the image being printed in the apparatus, since media width is the dimension required for loading onto the drum circumference and maintaining a vacuum seal. Importantly, the apparatus of the present invention orients donor media perpendicular to the direction of writing swaths when loaded on the imaging drum. This minimizes the additive effects of donor variation and writing swath direction, thereby minimizing visible artifacts, such as banding and/or streaking, in the output image.

SUMMARY OF THE INVENTION

The present invention is an improved image processing apparatus that uses an imaging drum and roll media. The axis of the horizontally disposed imaging drum is in parallel with the feed direction of the roll media, which results in a lower incidence of observable artifacts like banding and streaking in output images.

The invention includes methods for loading media in an image processing apparatus so as to minimize visible artifacts in the images produced by the apparatus. A method for loading roll media onto an imaging drum in an image processing apparatus using roll media comprises the steps of: 1) mounting a horizontally disposed imaging drum so that its axis is perpendicular to the axis of the roll media; 2) drawing a length of media from the roll, and separating a sheet of media from the roll; 3) feeding the sheet in a feed direction that is parallel to the drum axis; 4) attaching an edge of the sheet to the imaging drum by vacuum; 5) wrapping the sheet onto the imaging drum; and 6) transferring an image onto the sheet. Also included is a method for improving the quality of images produced by an image processing apparatus having a horizontally disposed imaging drum, which comprises the step of loading pre-cut, thermal print media into the image processing apparatus in a direction which is parallel to the axis of the imaging drum.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus and methods in accordance with the present invention. It is to be understood that elements, or steps, not specifically shown or described may take various forms well known to those skilled in the art.

Figure 1:
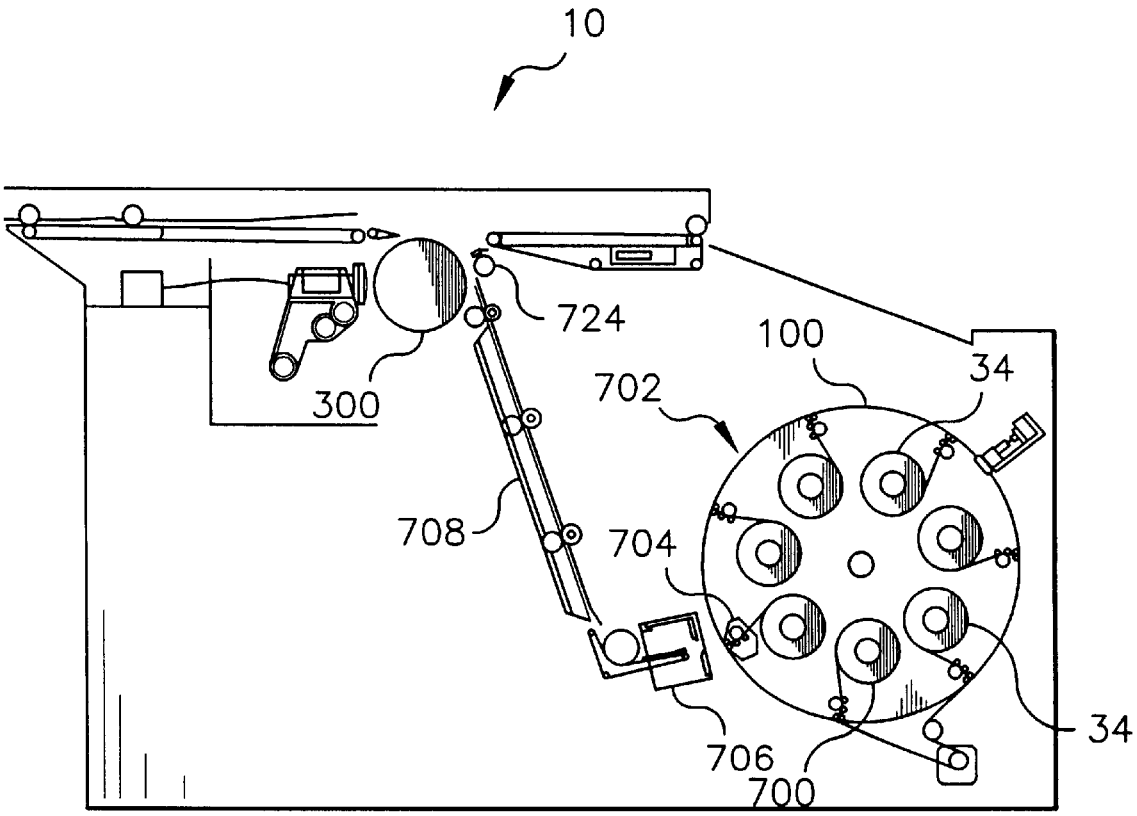
FIG. 1 (PRIOR ART)
FIG. 1 is an elevational view in vertical cross section of a prior art image processing apparatus, showing a conventional media feed subsystem.
Figure 2:
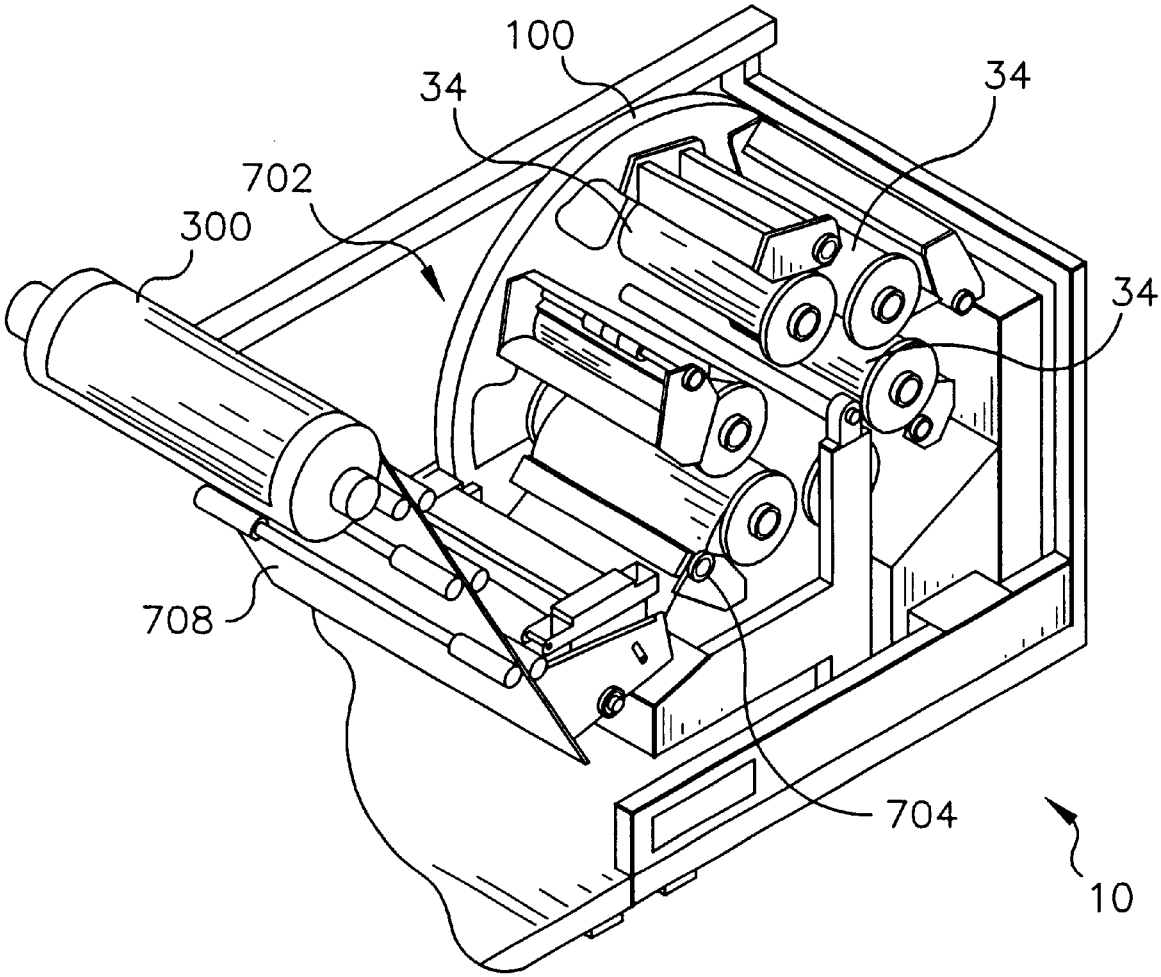
FIG. 2 (PRIOR ART)
FIG. 2 is a cutaway view in perspective of a prior art image processing apparatus, showing components of a conventional media feed subsystem.

Referring to FIGS. 1 and 2 (prior art), a vertical cross section showing a conventional media feed subsystem (FIG. 1), and a cutaway side view of a material supply assembly 702 (FIG. 2) of prior art image processing apparatus 10 are illustrated. A detailed description of operation of material supply assembly 702 can be found in U.S. Pat. No. 5,268,708, Harshbarger et al., issued Dec. 7, 1993. For perspective, a brief summary of the prior art operation follows: Donor and receiver media are loaded in image processing apparatus 10 in roll form. A media carousel 100 houses donor roll material 34 for the standard process colors (cyan, magenta, yellow, and black) and for any other special donor colors. Media carousel 100 also contains a roll of thermal print media 700. To load a sheet of donor roll material 34 or thermal print media roll material 700 onto vacuum imaging drum 300, carousel 100 rotates to a position. A material feeder assembly 704 feeds donor roll material 34 or thermal print media roll material 700 to a sheet cutter assembly 706 where the material is measured, then cut. A vertical sheet transport assembly 708 then feeds the cut sheet up to vacuum imaging drum 300. A sheet loading squeegee roller (not shown), is actuated to force the cut sheet against vacuum imaging drum 300. As disclosed in U.S. Pat. No. 5,268,708, the receiver sheet is held directly against the surface of vacuum imaging drum 300. At the conclusion of the media loading operation, the donor sheet is superposed on top of the receiver sheet on drum 300 and slightly overlaps the receiver sheet at the edges.

Figure 3:
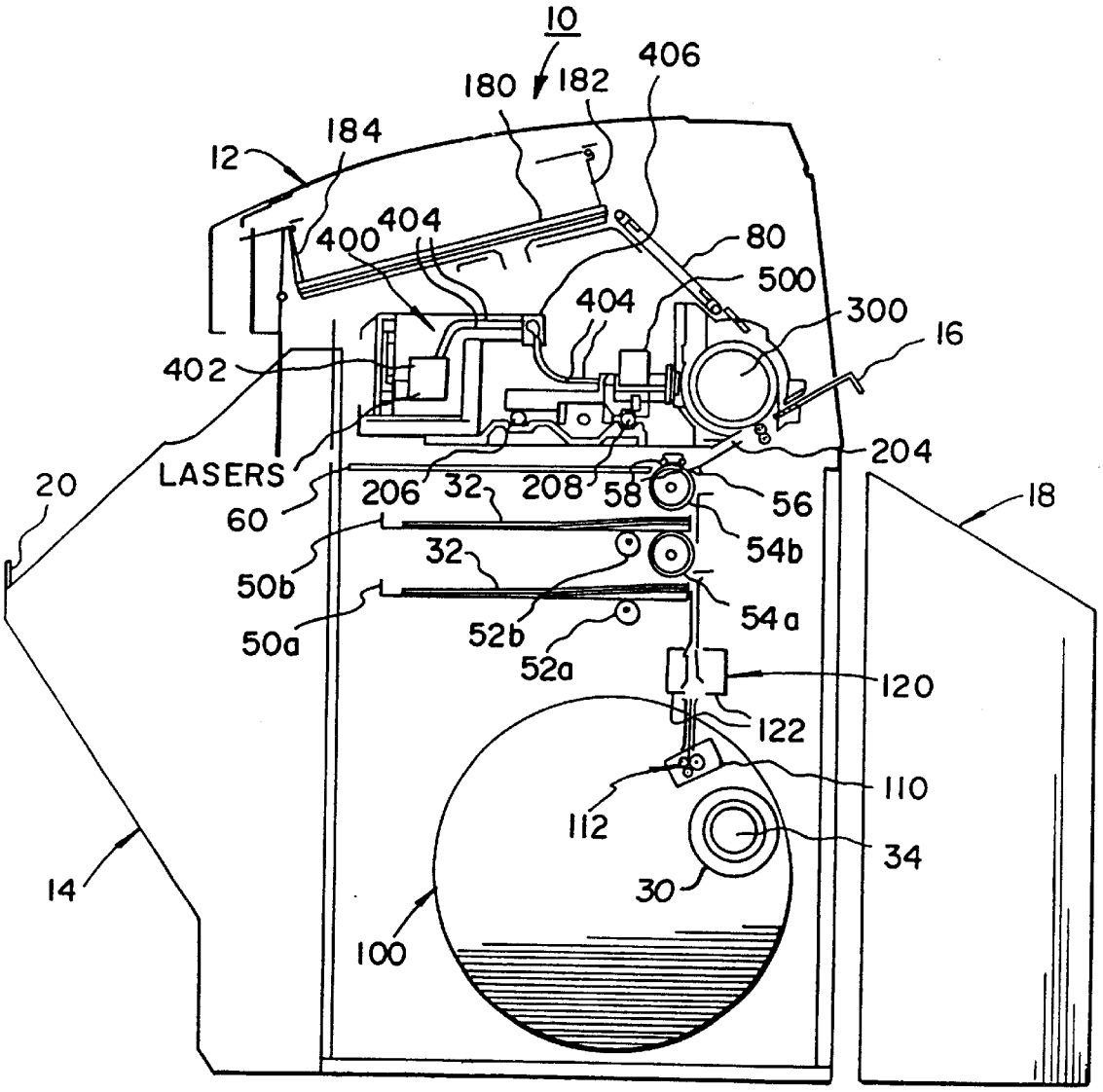
FIG. 3 (PRIOR ART)
FIG. 3 is an elevational view in vertical cross section of an alternate prior art image processing apparatus.

FIG. 3 illustrates an alternate prior art image processing apparatus 10 invention, where only donor material is provided in roll form. Receiver material is provided in sheet form. Image processing apparatus 10 has image processor housing 12, which provides a protective cover. A movable, hinged image processor door 14 is attached to the front portion of the image processor housing 12, permitting access to the two sheet material trays, lower sheet material tray 50*a* and upper sheet material tray 50*b*. These are positioned in the interior portion of image processor housing 12 for supporting thermal print media sheet 32 thereon. Only one of sheet material trays 50 will dispense the thermal print media sheet 32 out of its sheet material tray 50 to create an intended image thereon. The alternate sheet material tray either holds an alternative type of thermal print media sheet 32 or functions as a back up sheet material tray. In this regard, lower sheet material tray 50*a* includes a lower media lift cam 52*a* for lifting lower sheet material tray 50*a*, and ultimately the thermal print media sheet 32, upwardly toward rotatable, lower media roller 54*a* and toward a second rotatable, upper media roller 54*b*. When both are rotated, the thermal print media sheet 32 is pulled upwardly towards media guide 56. Upper sheet material tray 50*b* includes an upper media lift cam 52*b* for lifting upper sheet material tray 50*b,* and ultimately the thermal print media sheet 32, towards upper media roller 54*b,* which directs it towards a media guide 56.

The movable media guide 56 directs the thermal print media sheet 32 under a pair of media guide rollers 58, which engage the thermal print media sheet 32 for directing upper media roller 54*b* onto media staging tray 60, as shown in FIG. 3. Media guide 56 is attached and hinged to a lathe bed scanning frame at one end, and is uninhibited at its other end for permitting multiple positioning of media guide 56. Media guide 56 then rotates its uninhibited end downwardly, as illustrated in the position shown, and the direction of rotation of upper media roller 54*b* is reversed for moving the thermal print media 32 resting on media staging tray 60 under the pair of media guide rollers 58, upwardly through entrance passageway 204 and around rotatable vacuum imaging drum 300.

Continuing to refer to FIG. 3 (prior art), a roll 30 of donor roll material 34 is connected to media carousel 100 in a lower portion of image processor housing 12. Four rolls of roll media 30 are used, but only one is shown for clarity. Each roll media 30 includes a donor roll material 34 of a different color, typically black, yellow, magenta and cyan. These donor roll materials 34 are ultimately cut into donor sheet materials and passed to vacuum imaging drum 300 for forming the medium from which colorant imbedded therein is passed to thermal print media resting thereon. In this regard, media drive mechanism 110 is attached to each roll 30 of donor roll material 34, and includes three media drive rollers 112 through which the donor roll material 34 of interest is metered upwardly into media knife assembly 120.

After donor roll material 34 reaches a predetermined position, media drive rollers 112 cease driving the donor roll material 34 and two media knife blades 122 positioned at the bottom portion of media knife assembly 120 cut the donor roll material 34 into donor materials. Lower media roller 54*a* and upper media roller 54*b* along with media guide 56 then pass the donor sheet material onto media staging tray 60 and ultimately to vacuum imaging drum 300 and in registration with the thermal print media using the above process for passing the thermal print media onto vacuum imaging drum 300. The donor sheet material now rests atop the thermal print media, with a narrow space between the two created by microbeads embedded in the surface of the thermal print media.

A laser assembly 400 includes a plurality of laser diodes 402 in its interior (see FIG. 3-prior art). Laser diodes 402 are connected via fiber optic cables 404 to distribution block 406 and ultimately to printhead 500, as shown in FIG. 3 (prior art). Printhead 500 directs thermal energy received from laser diodes 402, causing the donor sheet material to pass the desired colorant across the gap and onto the thermal print media. Printhead 500 is attached to lead screw 250 via lead screw drive nut 254 and drive coupling 256 (not shown in FIG. 3) for permitting movement axially along the longitudinal axis of vacuum imaging drum 300 for transferring the data to create the intended image onto the thermal print media.

For writing, vacuum imaging drum 300 rotates at a constant velocity, and printhead 500 begins at one end of the thermal print media and traverses the entire length of the thermal print media for completing the transfer process for the particular donor sheet material resting on the thermal print media. After printhead 500 has completed the transfer process, for the particular donor sheet material resting on the thermal print media the donor sheet material is then removed from the vacuum imaging drum 300 and transferred out of image processor housing 12 via a skive or ejection chute 16. The donor sheet material eventually comes to rest in a waste bin 18 for removal by the user. This process is then repeated for the other three rolls of roll media 30 of donor roll materials 34.

After the color from all four sheets of the donor materials 36 has been transferred and the donor materials have been removed from vacuum imaging drum 300, the thermal print media is removed from vacuum imaging drum 300 and transported via transport mechanism 80 to colorant binding assembly 180. Entrance door 182 of colorant binding assembly 180 is opened for permitting the thermal print media to enter colorant binding assembly 180, and shuts once the thermal print media comes to rest in colorant binding assembly 180. Colorant binding assembly 180 processes the thermal print media for further binding the transferred colors on the thermal print media and for sealing the microbeads thereon. After the color binding process has been completed, media exit door 184 is opened and the thermal print media with the intended image thereon passes out of colorant binding assembly 180 and image processor housing 12 and comes to rest against a media stop 20.

Figure 4:
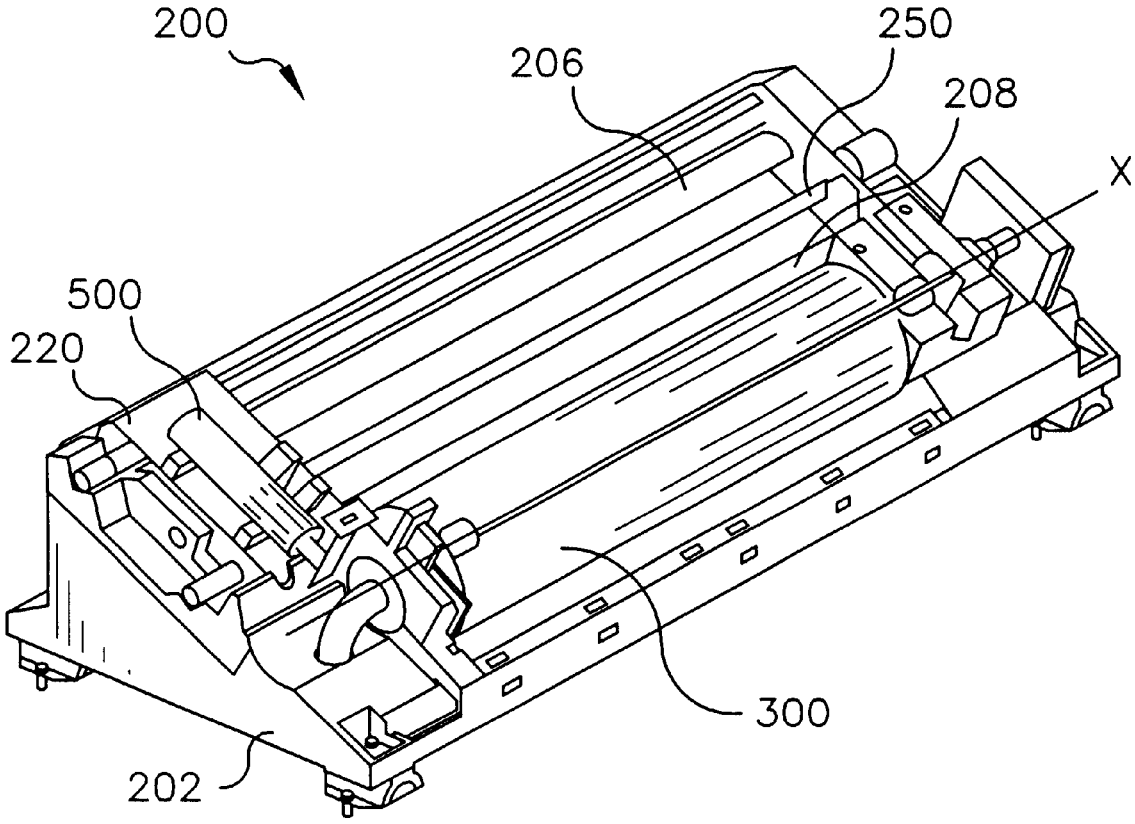
FIG. 4 is a perspective view of a lathe-bed scanning subsystem, or write engine, of an imaging apparatus according to the present invention, as viewed from the rear of the image processing apparatus.

Referring to FIG. 4, a lathe bed scanning subsystem 200, or write engine, of an imaging apparatus according to the present invention is shown. The lathe bed scanning subsystem 200 of image processing apparatus 10 comprises a vacuum imaging drum 300, printhead 500, and a lead screw 250 assembled in a lathe bed scanning frame 202. The vacuum imaging drum 300 is mounted for rotation about its longitudinal axis, X, in lathe bed scanning frame 202. Printhead 500 is movable with respect to vacuum imaging drum 300, and is arranged to direct a beam of light to the donor sheet material 36 (not shown). The beam of light from printhead 500 for each laser diode 402 (not shown in FIG. 4) is modulated individually by modulated electronic signals from image processing apparatus 10. These are representative of the shape and color of the original image, so that the color on the donor sheet material 36 is heated to cause volatilization only in those areas in which its presence is required on the thermal print media 32 to reconstruct the shape and color of the original image.

Continuing to refer to FIG. 4, the printhead 500 is mounted on a movable translation stage member 220 which, in turn, is supported for low friction slidable movement on translation bearing rods 206 and 208. Translation bearing rods 206 and 208 are sufficiently rigid so as not to sag or distort as is possible between their mounting points. The translation bearing rods are arranged to be as parallel as possible with axis X of vacuum imaging drum 300, with the axis of printhead 500 being perpendicular to the axis X of vacuum imaging drum 300. A front translation bearing rod 208 locates translation stage member 220 in the vertical and the horizontal directions with respect to axis X of vacuum imaging drum 300. A rear translation bearing rod 206 locates translation stage member 220 only with respect to rotation of translation stage member 220 about front translation bearing rod 208 so that there is no over-constraint condition of translation stage member 220. Such a condition might cause it to bind, chatter, or cause printhead 500 to vibrate or jitter during the generation of an intended image.

The printhead 500 travels in a path along vacuum imaging drum 300, while being moved at a speed synchronous with the vacuum imaging drum 300 rotation and proportional to the width of a writing swath 450, not shown. The pattern that printhead 500 transfers to the thermal print media 32 along vacuum imaging drum 300 is a helix.

Figure 5:
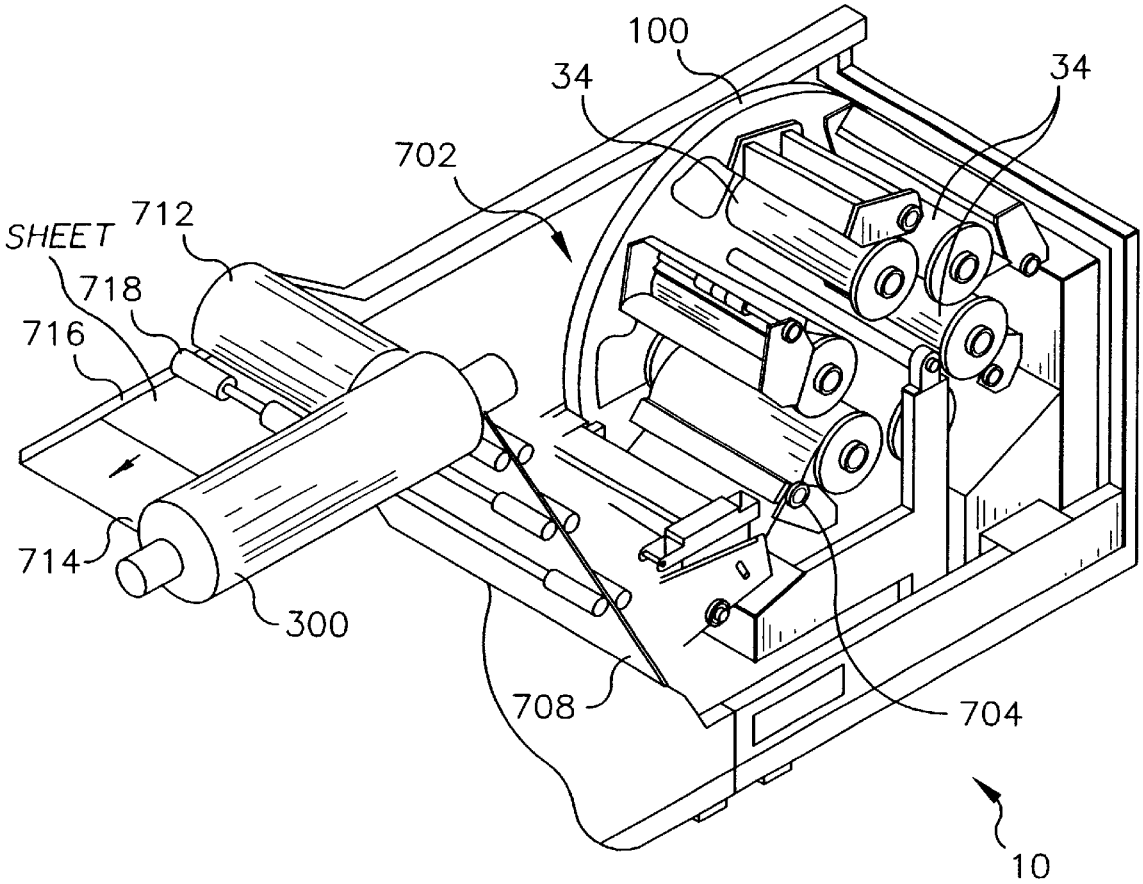
FIG. 5 is a perspective, cutaway view of a media feed subsystem of an imaging apparatus according to the present invention.

Referring to FIG. 5, a preferred embodiment of a media feed subsystem according to the present invention has a vacuum imaging drum 300 that is oriented at a right-angle relative to its orientation in the prior art apparatus. Importantly, the imaging drum is mounted with its axis in parallel with the feed direction of a sheet of media from the roll media. (The lathe bed scanning frame and support components are not shown here for clarity.) As a sheet of thermal print media is fed from a vertical sheet transport assembly 708, a hood 712 curves the sheet of thermal print media onto a sheet feed tray 714. A set of guide rollers 718 urge the sheet forward in sheet feed tray 714. A guide edge 716 serves to align the sheet into feed position for vacuum imaging drum 300. The preferred vacuum imaging drum 300 has the overall configuration and set of surface features of vacuum imaging drums disclosed in detail in U.S. Pat. No. 5,777,658, Kerr et al., issued Jul. 7, 1998, and U.S. Pat. No. 5,276,464, Kerr et al., issued Jan. 4, 1994. A material supply assembly 702 is shown in FIG. 5. A media carousel 100 houses donor roll material 34, and a material feeder assembly 704 feeds donor roll material 34 to a cutter.

Figure 6A:
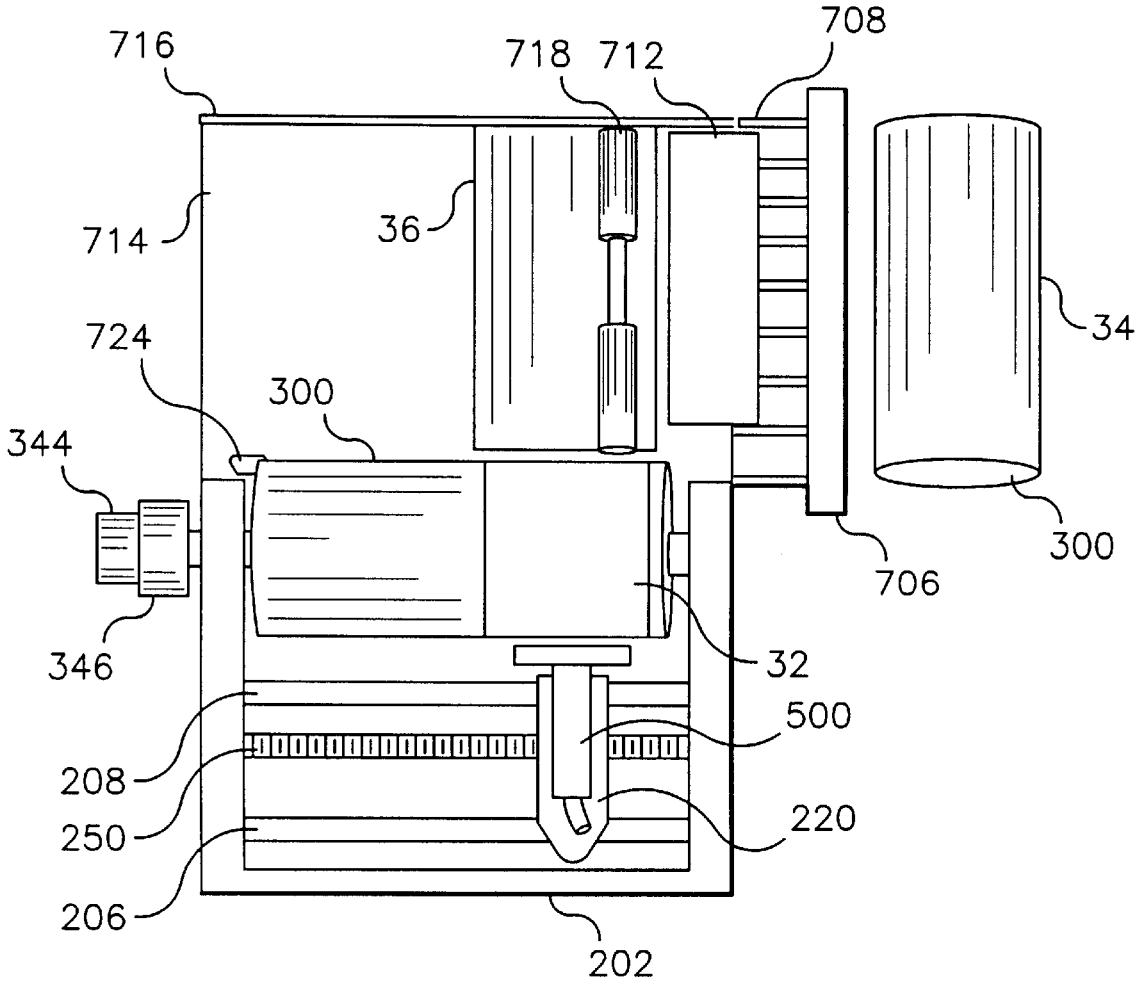
FIGS. 6A & B show a plan view, schematic representation of a media feed subsystem of an imaging apparatus according to the present invention, showing imaging for a half-size sheet.
Figure 6B:
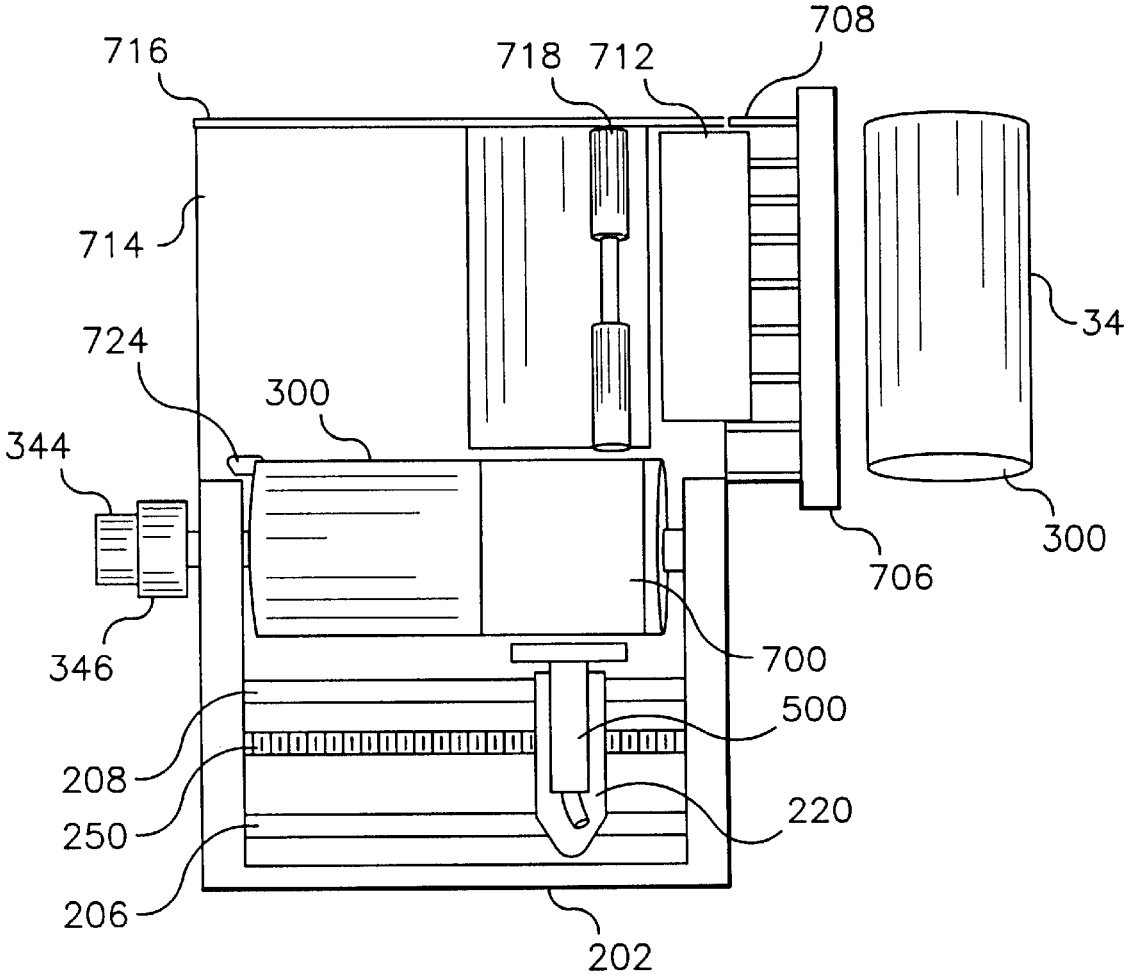
Figure 7A:
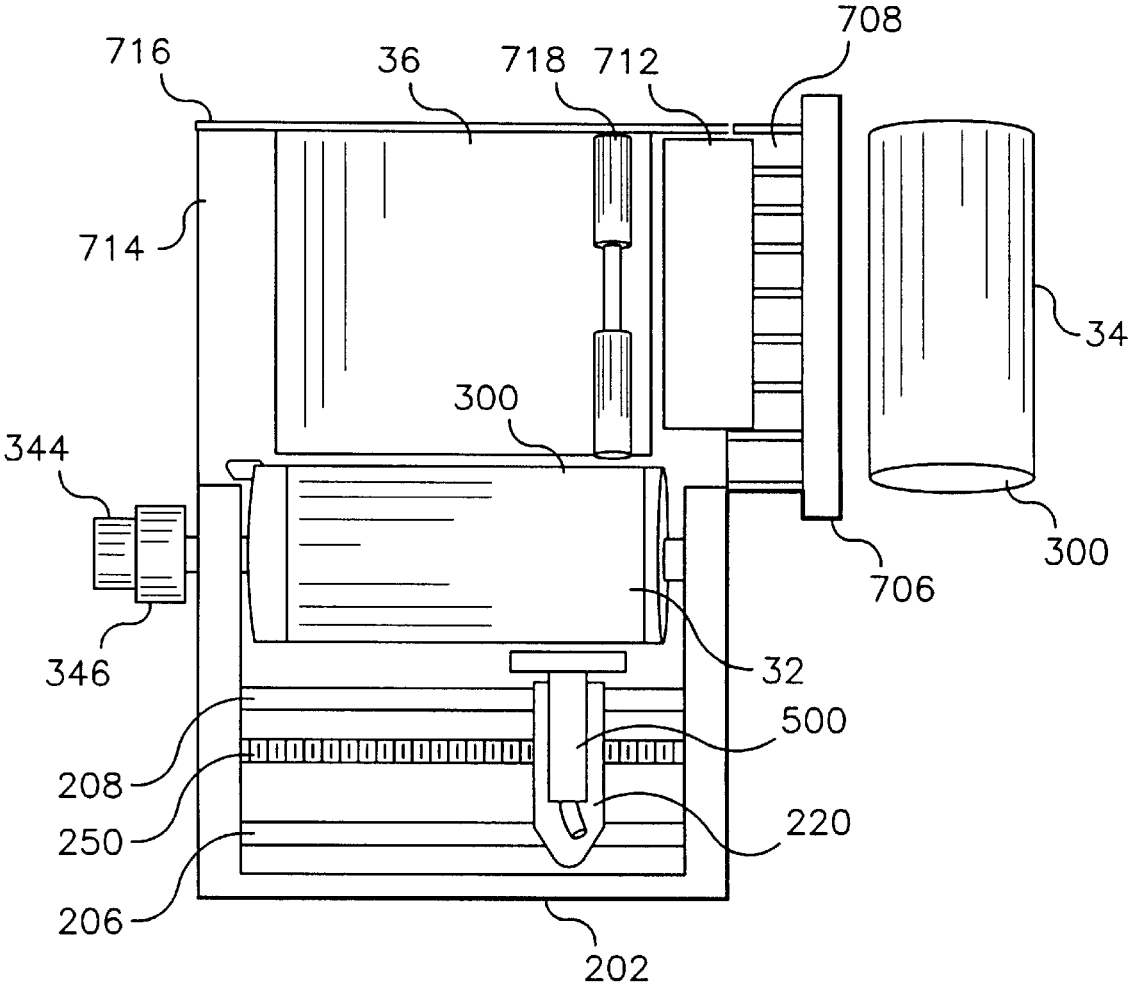
FIGS. 7A & B show a plan view, schematic representation of a media feed subsystem of an imaging apparatus according to the present invention, showing imaging for a full-size sheet.
Figure 7B:
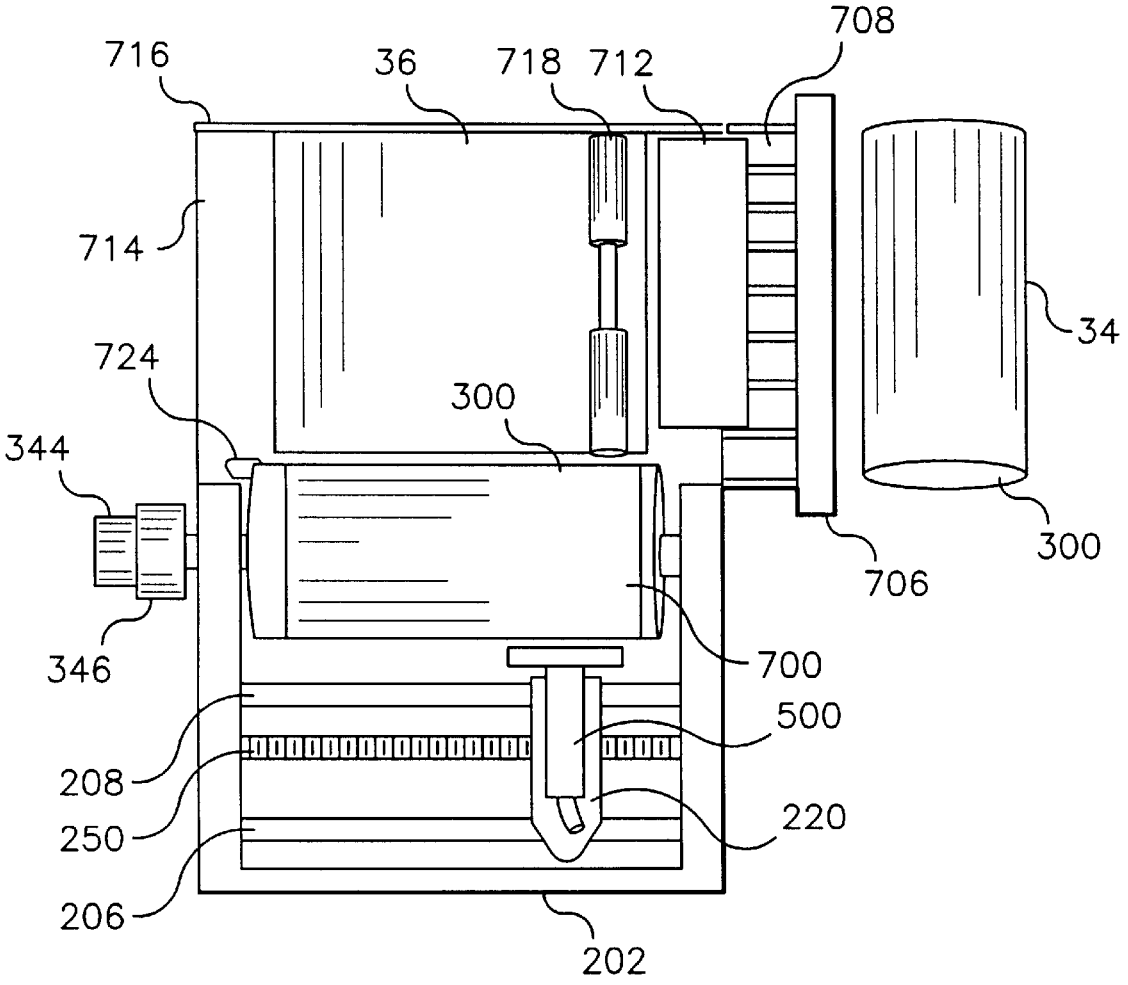

FIGS. 6A & B and 7A & B show an apparatus according to the present invention rigged for loading of sheets sized for two (FIGS. 6A & B) or four (FIGS. 7A & B) standard DIN A4 images. FIGS. 6A and 7A show the apparatus with a thermal print media sheet 32 and a donor sheet 36, while FIGS. 6B and 7B show the precursor thermal print media roll material 700 (precursor to thermal print media sheet 32) and donor roll material 34 (precursor to donor sheet 36). When the present apparatus is in use, thermal print media roll material 700 is measured, and is cut by sheet cutter assembly 706 into a cut sheet of thermal print media 32. The cut sheet is of an appropriate length for imaging two side-by-side A4 images. Thermal print media sheet 32 is then fed by vertical sheet transport assembly 708 to vacuum imaging drum 300, which is shown in FIG. 6A. A sheet loading squeegee roller 724 is mounted axially of vacuum imaging drum 300 for selective engagement with the drum, as shown in FIGS. 6A & B and 7A & B. Sheet loading squeegee roller 724 is actuated by means of a solenoid (not shown) to force thermal print media 32 against the drum during loading. This provides a tight vacuum seal that holds thermal print media sheet 32 securely. In similar fashion, a roll of donor material 34 is then measured, cut into donor sheet 36, and guided onto vacuum imaging drum 300. A drum motor 346 and drum encoder 344 provide precise positioning of vacuum imaging drum 300 to allow mounting of thermal print media sheet 32 onto the drum and precise positioning of donor sheet 722 on top of thermal print media sheet 32 on the drum.

Continuing to refer to FIGS. 6A & B and 7A & B, the vacuum imaging drum 300, printhead 500, and a lead screw 250 are assembled in a lathe bed scanning frame 202. A hood 712 curves the sheet of thermal print media onto a sheet feed tray 714. A set of guide rollers 718 urge the sheet forward in sheet feed tray 714. A guide edge 716 serves to align the sheet into feed position for vacuum imaging drum 300. A printhead 500 is mounted on a movable translation stage member 220 which, in turn, is supported for low friction slidable movement on translation bearing rods 206 and 208.

As shown in FIGS. 7A & B, an apparatus according to the present invention is used to load a larger sheet, which is sized for four standard DIN A4 images. For imaging at this larger size, thermal print media sheet 32 is measured at substantially twice the length of the corresponding sheet 32 used in FIG. 6A (example sized for two A4 images). Significantly, the same sequence described with reference to FIG. 6 is followed for loading larger thermal print media sheet 32, and correspondingly larger donor sheet 36, onto vacuum imaging drum 300 as shown in FIG. 7A.

Using the drum loading apparatus of the present invention, imaging operation proceeds with successive separations imaged using additional donor sheets 722, as disclosed in U.S. Pat. No. 5,268,708. In the present invention, feed tray 714 also serves as an exit tray for spent donor sheets 722 and for the intermediate image printed onto receiver sheet 720 when all separations have been completed. Spent donor sheets 722 are fed back from the drum into feed tray 714 by stopping drum 300, partially releasing vacuum hold on the spent media edge, and rotating drum 300 in reverse direction. Guide rollers 718 then eject the spent sheet from feed tray 714.

In the apparatus of the present invention, the apparatus is purposefully arranged so that the media on the drum is parallel to the axial drum direction, and perpendicular to the writing direction. This is because it has been found here that when the coating direction is parallel to the writing direction, any defects from coating and writing are additive; that is, there is a greater incidence of visible artifacts in the images generated by the apparatus. When, however, the coating direction is perpendicular to the writing direction, any coating defects such as a streaks or bands are not as easily perceived by the naked eye. Therefore, in the present invention, the imaging drum is mounted with its axis in parallel with the feed direction of the roll media.

The thermal print media used in the apparatus of the present invention may be sheet fed, or supplied in roll form. A third alternative is use of an existing image processing apparatus (having an imaging drum and employing thermal print media) to achieve the same benefit, a lower incidence of visible defects. The user may accomplish this end by loading the media in such as way as to cause the coating direction to be perpendicular to the writing direction.

The present invention includes a method for improving the quality of images produced by an image processing apparatus having an imaging drum. The method comprises the step of loading pre-cut thermal print media into an image processing apparatus in a direction which is parallel to the axis of the imaging drum in the apparatus. The loading is preferably done from a feeder tray which holds pre-cut thermal print media sheets. The method preferably further comprises the steps of loading each thermal print media sheet onto the imaging drum, and coating the sheets in a direction that is perpendicular to the writing direction in the image processing apparatus. Alternatively, this invention includes a method for improving the quality of images produced by an image processing apparatus having an imaging drum, where the method comprises the step of feeding pre-cut, thermal print media sheets to an imaging drum in a direction which results in the coating direction in the image processing apparatus being perpendicular to the writing direction on the media sheets.

The present invention also contemplates an image processing apparatus for sheet fed thermal print media and donor materials. Here, the sheets are pre-cut and supplied as cut sheet material. In this embodiment, a sheet feeder orients pre-cut sheets of media such that the coating direction is parallel to the axial drum direction.

The thermal print media may be paper, where images are being transferred directly to paper, or it may be an intermediate, where the image is being transferred to an intermediate sheet, and from there to paper stock.

The present invention includes a method for loading roll media onto an imaging drum in an image processing apparatus using roll media, which comprises the steps of: a) mounting a horizontally disposed imaging drum so that its axis is perpendicular to the axis of the roll media; b) drawing a length of media from the roll, and separating a sheet of media from the roll; c) feeding the sheet in a feed direction that is parallel to the drum axis; d) attaching an edge of the sheet to the imaging drum by vacuum; e) wrapping the sheet onto the imaging drum; and f) transferring an image onto the sheet. These are preferably completed in the order indicated. The length of media in the drawing step has a plurality of length dimensions. Each media sheet need not be the same length.

The present invention has been described with reference to the preferred embodiment. As will be readily apparent to those skilled in the art, a number of variations are possible within the scope of the invention as disclosed here. For example, this invention could be used with any number of imaging drum designs in addition to the two-A4 and four-A4 configurations disclosed. The invention could be used on an imaging drum that uses, for example, a mechanical clamp or other arrangement rather than a vacuum to hold media sheets. An imaging drum could be configured to hold a printing plate or a film for imaging, rather than a receiver/donor combination. An image processing apparatus could use sheets for receiver media and rolls for donor media, as shown in FIG. 3 (prior art). A number of variations are possible in the arrangement of holding trays and guides. Exit trays could be configured differently, using, for example, a separate exit tray for waste donor sheets.

Although not described in detail, it would be obvious to someone skilled in the art that this invention could be used in applications other than that of the preferred embodiment, which is described herein. For example, the method of this invention could be applied in an imaging system that uses only a single sheet rather than the superposed donor-receiver combination of the preferred embodiment, as noted above. This method could also be used in combination with a drum design that incorporates masking or clamping hardware instead of, or in addition to, vacuum.

The invention has been described in detail with particular reference to certain preferred embodiments thereof, but it will be understood that variations and modifications can be effected within the spirit and scope of the invention. It is intended that the doctrine of equivalents be relied upon to determine the fair scope of these claims in connection with any other person's product that falls outside the literal wording of these claims, but which in reality does not materially depart from this invention.

PARTS LIST

10. Image processing apparatus
12. Image processor housing
14. Image processor door
16. Donor ejection chute
18. Donor waste bin
20. Media stop
30. Roll media
32. Thermal print media sheet
34. Donor roll material
36. Donor sheet
50. Sheet material trays
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
98. Master lathe bed scanning engine
100. Media carousel
110. Media drive mechanism
112. Media drive rollers
120. Media knife assembly
122. Media knife blades
180. Colorant binding assembly
182. Media entrance door
184. Media exit door
198. Master Lathe Bed Scanning Engine
200. Lathe bed scanning subsystem
202. Lathe bed scanning frame
204. Entrance passageway
206. Rear translation bearing rod
208. Front translation bearing rod
220. Translation stage member
250. Lead screw
252. Threaded shaft
254. Lead screw drive nut
256. Drive coupling
258. Linear drive motor
260. Axial load magnets
260*a*. Axial load magnet
260*b* Axial load magnet
262. Circular-shaped boss
264. Ball bearing
266. Circular-shaped insert
268. End cap
270. Hollowed-out center portion
272. Radial bearing
292. Rotational stop
294. Collar head angle magnet
298. Vacuum nozzle
300. Vacuum imaging drum
301. Axis of rotation
302. Vacuum drum housing
306. Vacuum hole
322. Axially extending flat
324. Donor support ring
332. Vacuum grooves
344. Drum encoder
346. Drum motor
400. Laser assembly
402. Laser diodes
404. Fiber optic cables
406. Distribution block
450. Writing swath
500. Printhead
700. Thermal print media roll material
702. Material supply assembly
704. Material feeder assembly
706. Sheet cutter assembly
708. Vertical sheet transport assembly
712. Hood
714. Feed tray
716. Guide edge

718. Guide rollers

724. Sheet loading squeegee roller

What is claimed is:

1. An improved image processing apparatus of the type including an imaging drum and roll media, wherein the improvement comprises a horizontally disposed imaging drum with its axis in parallel with the feed direction of a sheet of media from said roll media.

2. The apparatus according to claim 1, wherein sheet of the media is held on a vacuum imaging drum.

3. The apparatus according to claim 1, wherein the roll media is a color donor material.

4. A method for loading roll media onto an imaging drum in an image processing apparatus using roll media, which comprises the steps of:

mounting a horizontally disposed imaging drum so that its axis is perpendicular to the axis of the roll media;

drawing a length of media from the roll, and separating a sheet of media from the roll;

feeding the sheet in a feed direction that is parallel to the drum axis;

attaching an edge of the sheet to the imaging drum by vacuum;

wrapping the sheet onto the imaging drum; and transferring an image onto the sheet.

5. The method according to claim 4, wherein the length of media in the drawing step has a plurality of length dimensions.

6. A method for improving the quality of images produced by an image processing apparatus having a horizontally disposed imaging drum, the method comprising the step of loading pre-cut, thermal print media into the image processing apparatus in a direction which is parallel to the axis of the imaging drum in the apparatus.

7. The method according to claim 6, wherein the loading is from a feeder tray which holds pre-cut thermal print media sheets.

8. The method according to claim 7, further comprising the steps of loading each thermal print media sheet onto the imaging drum, and coating the sheets in a direction that is perpendicular to the writing direction in the image processing apparatus.

* * * * *